US009193521B2

(12) United States Patent
Wilhelm

(10) Patent No.: US 9,193,521 B2
(45) Date of Patent: Nov. 24, 2015

(54) RETAIL AND RECYCLE READY CONTAINER

(71) Applicant: Troy Wilhelm, McLean, VA (US)

(72) Inventor: Troy Wilhelm, McLean, VA (US)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 14/204,997

(22) Filed: Mar. 11, 2014

(65) Prior Publication Data

US 2014/0263307 A1 Sep. 18, 2014

Related U.S. Application Data

(60) Provisional application No. 61/791,529, filed on Mar. 15, 2013.

(51) Int. Cl.

| | |
|---|---|
| ***B65D 88/52*** | (2006.01) |
| ***B65D 5/32*** | (2006.01) |
| ***B65D 5/68*** | (2006.01) |
| ***B65D 5/38*** | (2006.01) |
| ***B65D 5/54*** | (2006.01) |

(52) U.S. Cl.

CPC ..... *B65D 88/522* (2013.01); *B65D 5/32* (2013.01); *B65D 5/321* (2013.01); *B65D 5/38* (2013.01); *B65D 5/54* (2013.01); *B65D 5/68* (2013.01)

(58) Field of Classification Search

CPC ..... B65D 5/542; B65D 5/68; B65D 5/725; B65D 5/4608; B65D 5/54; B65D 5/321; B65D 5/38

USPC ..... 220/6, 62, 212, 366.1, 671.1, 62.1, 666, 220/676, 761; 229/117.13, 124, 121, 122.2; 493/309

See application file for complete search history.

(56) References Cited

U.S. PATENT DOCUMENTS

| | | | | |
|---|---|---|---|---|
| 1,960,925 | A | 5/1934 | Senat | |
| 2,583,211 | A | 1/1952 | Fleming | |
| 3,235,166 | A | 2/1966 | Guyer | |
| 3,055,573 | A | 9/1966 | Carter | |
| 3,910,483 | A | 10/1975 | Ritter | |
| 3,967,774 | A | 7/1976 | Querner | |
| 4,127,228 | A * | 11/1978 | Hall | 229/117.16 |
| 4,848,651 | A | 7/1989 | Hartness | |
| 5,348,147 | A * | 9/1994 | Gottfreid | 206/215 |
| 5,507,430 | A | 4/1996 | Imhoff | |
| 5,779,048 | A | 7/1998 | Dunn | |
| 5,839,651 | A * | 11/1998 | Teags et al. | 229/125.32 |
| 6,129,211 | A | 10/2000 | Prakken | |
| 6,220,507 | B1 | 4/2001 | Guillin | |
| 7,455,215 | B2 * | 11/2008 | McLeod et al. | 229/120.26 |

(Continued)

FOREIGN PATENT DOCUMENTS

| | | | |
|---|---|---|---|
| EP | 1818268 | A1 | 8/2007 |
| FR | 2777259 | A1 | 10/1999 |

(Continued)

*Primary Examiner* — Robert J Hicks
*Assistant Examiner* — Kareen Thomas
(74) *Attorney, Agent, or Firm* — Tracey S. Truitt; Kelley A. Schnieders; Polsinelli PC

(57) ABSTRACT

A shipping container particularly adapted for both displaying goods therein and flattening to a single panel after use is provided herein. The shipping container apparatus is ready for unfolding and is convertible for storage and/or recycling. The shipping container includes a lid releasably attachable to a tray, wherein the lid has at least one wall member juxtaposed to at least one portion of the tray.

20 Claims, 4 Drawing Sheets

(56) References Cited

U.S. PATENT DOCUMENTS

| | | | |
|---|---|---|---|
| 2003/0116613 | A1 | 6/2003 | McLeod |
| 2004/0074956 | A1 | 4/2004 | Sax |
| 2004/0222127 | A1 | 11/2004 | McLeod |
| 2007/0221715 | A1 | 9/2007 | Tibbels |

FOREIGN PATENT DOCUMENTS

| | | | |
|---|---|---|---|
| FR | 2887228 | A1 | 12/2006 |
| GB | 2332421 | A | 3/1999 |
| ZA | 200108995 | A | 10/2002 |

* cited by examiner

RETAIL AND RECYCLE READY CONTAINER

CROSS-REFERENCE TO RELATED APPLICATION

This application claims priority under 35 U.S.C. 119(e) and 37 C.F.R. 1.78 based upon U.S. Provisional Application Ser. No. 61/791,529 for RETAIL AND RECYCLE READY CONTAINER filed Mar. 15, 2013, the entirety of which is incorporated herein by reference.

FIELD OF INVENTION

The present invention relates in general to a shipping container apparatus for goods, and, more particularly, to a shipping container apparatus for goods which is ready for unfolding such that it can be easily flattened into a single panel after use such that the container is ready for recycling.

BACKGROUND OF THE INVENTION

The use of shipping containers is a very common practice. For shipping purposes, these containers are increasingly being used for displaying goods for sale within the containers. After using these containers, they are often stacked on top of each other in a storage place waiting to be crushed upon or after collection for recycling or taken to a landfill. Often, a knife or blade is used to cut the container to dissect the box into pieces to save storage room. Sometimes, the containers are cut and a portion of the container removed such that the container also operates as a display device while goods are still in the container. These practices suffer from many drawbacks including the problems that they are often time consuming, may result in damage to the goods through inadvertent contact with the knife during cutting, as well as dangerous to the individual cutting the box into pieces. The pieces of the container resulting from the cutting may be of various sizes and have irregular shapes and sharp edges, which make the subsequent sorting, stacking, wrapping, or fastening for storage or recycling inconvenient and inefficient. Additionally, cutting a portion of the container using a knife often leads to an unappealing visual display of the product inside the container.

Accordingly, one aspect of the container described herein provides a shipping container apparatus for goods which is convertible to a flattened single panel without the need of a tool, such as a knife or blade. In another aspect of the container described herein, a structurally sound shipping container apparatus for goods is provided wherein the container has a lid which is detachably secured to a tray. Advantageously, the lid is easily removable and flattenable for purposes of storing or recycling the lid material.

These and other aspect, objects, and features of the container described herein will become apparent in light of the present specification, claims and drawings.

SUMMARY OF THE INVENTION

The present invention generally provides a shipping container apparatus ready for unfolding in order to conveniently display the product or goods therein. Preferably, the shipping container apparatus is also convertible to a flattened single panel for storage and/or recycling. Still more preferably, the flattening of the container can be accomplished without the use of any tools including knives or blades. The shipping container apparatus generally comprises: a lid releasably attachable to a tray, wherein the lid has at least one wall member juxtaposed to at least one portion of the tray member. In preferred forms, the wall member has a line of weakness horizontally aligned below a removably attached flap that extends in a direction away from the tray when the lines of weakness are broken.

In one aspect of containers described herein, the container includes a lid means releasably attached to tray means. The lid means includes at least two parallel lid wall members, each having two half members adjacent to a frangibly integrated partially separable flip member, and one top flap member, wherein said half members and said frangibly integrated partially separable flip members share a first perforation line parallel to lid top member, wherein said frangibly integrated partially separable flip members share a second perforation line overlapping with a folding line vertical to said lid top member between two adjacent lid wall members, and wherein said top flap member articulates from lid top wall member at fold line and is attached to said two frangibly integrated partially separable flip member during said movement; (2) flap opening means for facilitating movement of said half members, said frangibly integrated partially separable flip members, and said top flap member from a substantially closed position to a substantially open position; and (3) tray means for holding and displaying said goods, said tray means having a bottom panel member and at least one tray wall member.

Each of said two parallel lid wall members of the lid of said shipping container apparatus have two half members that include at least one frangibly integrated separable member, said frangibly integrated separable member surrounded by a fully frangible third perforation line encircling a periphery of said at least one frangibly integrated separable member to enable complete separation of said at least one frangibly integrated separable member from said at least one lid wall member. Said frangibly integrated separable member of the shipping apparatus may be separated from said lid wall member and forms at least one handle aperture through said at least one lid wall member of said lid means. In one embodiment, each of said two parallel lid wall members of said shipping container apparatus has two half members including one frangibly integrated separable member, such that each of the two halves of said lid wall member has half of a configuration of said frangibly integrated separable member; specifically said fully frangible third perforation line encircling a periphery of said frangibly integrated separable member is configured as substantially round, oval or any other shape. Said frangibly integrated separable member may be separated from said lid wall member and forms one handle aperture through said at least one lid wall member of said lid means, wherein each of the two halves of said lid wall member has half of a configuration of said handle aperture.

In one example of the shipping container apparatus, said flap opening means is at least integrated in said lid means for facilitating movement of said half members, said frangibly integrated partially separable flip members, and said top flap member, from a substantially closed position to a substantially open position. Said flap opening means comprises: (1) prompting said at least one frangibly integrated separable member, such that said frangibly integrated separable member separates from a fully frangible third perforation line to create a handle aperture; wherein said handle aperture has the same configuration and with substantially same size as the frangibly integrated separable member, such that two, three, four, six or eight fingers of an average person to fit in; (2) pulling the periphery line of said handle aperture and exerting force enough to break the said first perforation line, such that said two half members adjacent to said frangibly integrated partially separable flip member are movable; and (3) pulling said frangibly integrated partially separable flip member on the side with broken said first perforation line, such that said second perforation line overlapping with said folding line vertical to said lid top member between two adjacent lid wall members is broken, wherein said frangibly integrated partially separable flip members are moveable, and wherein said frangibly integrated partially separable flip members are attached to said top tap member during the movement. In some examples, said flap opening means may further comprise spreading all said half members, said top flap member attached frangibly integrated partially separable flip members and unfolding said opposing lid side walls, such that all facets of said lid means are laid flat in a single panel in one dimension.

Said at least one top flap member of said shipping container apparatus has a substantially inverted trapezoidal configuration. In one example, said top flap member has a height slightly shorter than or equivalent to the height of said frangibly integrated partially separable flip member.

In one example, said lid means of the shipping container apparatus has a substantially rectangular configuration. Similarly, said tray means of the shipping container apparatus has a substantially rectangular configuration as well. In one specific example, said lid means has two side wall members, a front wall member, and a back wall member; whereas said tray means has two side wall members, a front wall member, and a back wall member. In one specific example of the shipping container apparatus in which said lid means includes opposing lid front wall member and lid back wall member, each of said lid front wall member and lid back wall member including a corresponding frangibly integrated separable member; and said tray means includes two opposing lid front wall members and lid back wall members, each of said lid front wall members and lid back wall members including a corresponding frangibly integrated separable member, each said frangibly integrated separable member of said tray means overlaps with corresponding frangibly integrated separable member of lid means; wherein removal of corresponding frangibly integrated separable member of said lid means and tray means forms a handle aperture enabling carrying the goods in said shipping apparatus comprising both said lid means and said tray means; wherein said lid means is positioned attachable to at least a corresponding portion of said tray means, and wherein said lid means is positionable over or inside said tray means.

Said lid means and said tray means of said shipping container apparatus may be constructed from corrugated paperboard materials. Further, said top flap member articulates from lid top wall member at a fold line and is attached to said two frangibly integrated partially separable flip members using an adhesive capable of effecting a paperboard to paperboard bond disposed between. Said adhesive may comprise a cold resin adhesive, and said cold resin adhesive may comprise a polyvinyl acetate adhesive. Alternatively, said adhesive comprises a hot-melt type adhesive.

DETAILED DESCRIPTION

Figure 1:
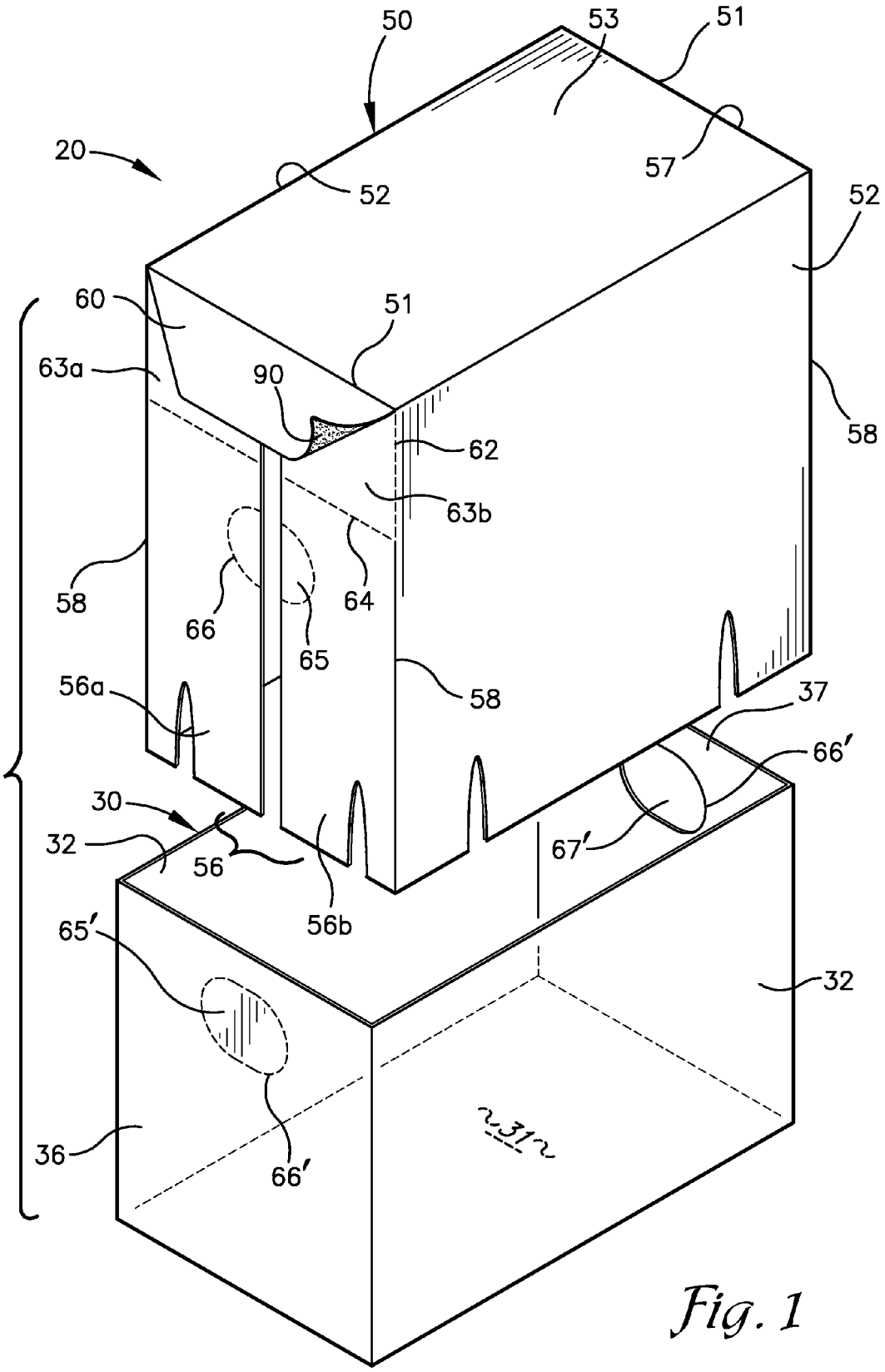
FIG. 1 of the drawings is an exploded perspective view of a shipping container embodying the present invention and having an erected lid means and tray means, showing, in particular, the lid means comprising all members in a substantially closed position, with a portion of the top flap broken away to show the adhesive.

The embodiments of the invention described herein are illustrative of the present invention and are not meant to be limiting.

One preferred embodiment of the present shipping container apparatus 20 is shown in FIGS. 1-4 as comprising lid means 50. Lid means 50, releasably attachable to tray means 30, includes two opposing lid side wall members 52, lid front wall member 56 comprising two half members 56*a* and 56*b*, and lid back wall member 57 comprising two half members 57*a* and 57*b*. Each of the lid front wall member 56 and the lid back wall member 57 includes side folding lines 58. Each of the lid front wall member 56 and the lid back wall member 57 further includes a top flap member 60, articulating from lid top wall member 53 at fold line 51. Each of the lid front wall half members 56*a* and 56*b*, and each of the lid back wall half members 57*a* and 57*b* is adjacent to a frangibly integrated partially separable flip member 63*a* and 63*b*, respectively. The two frangibly integrated partially separable flip member 63*a* and 63*b* each comprises a side folding line with perforation 62 vertical to the lid top wall member 53, a bottom perforation line 64 parallel to the folding line 51, and the perforation line 64 is shared by 63*a* (and 63*b*) and 56*a* (and 56*b*) at the lid front wall member side. Similarly, the perforation line 64 at the lid back wall member side is shared by 63*a* (and 63*b*) and 57*a* (and 57*b*).

As shown in FIG. 1, each of the lid front wall member 56 and the lid back wall member 57 further includes one frangibly integrated separable member 65, surrounded by a fully frangible perforation line 66. Frangibly integrated separable member 65 is so positioned such that each of the two halves of lid front wall member 56 and lid back wall member 57 has half of the configuration of this frangibly integrated separable member 65.

As shown in detail in FIG. 1, adhesive 90, capable of effecting a paperboard to paperboard bond, is disposed between and affixes the top flap member 60 of lid means 50 to frangibly integrated partially separable members 63*a* and 63*b* of each of the lid front wall member 56 and the lid back wall member 57. Adhesive 90 is preferably a cold resin adhesive, such as a polyvinyl acetate adhesive, or a hot-melt type adhesive.

Figure 2:
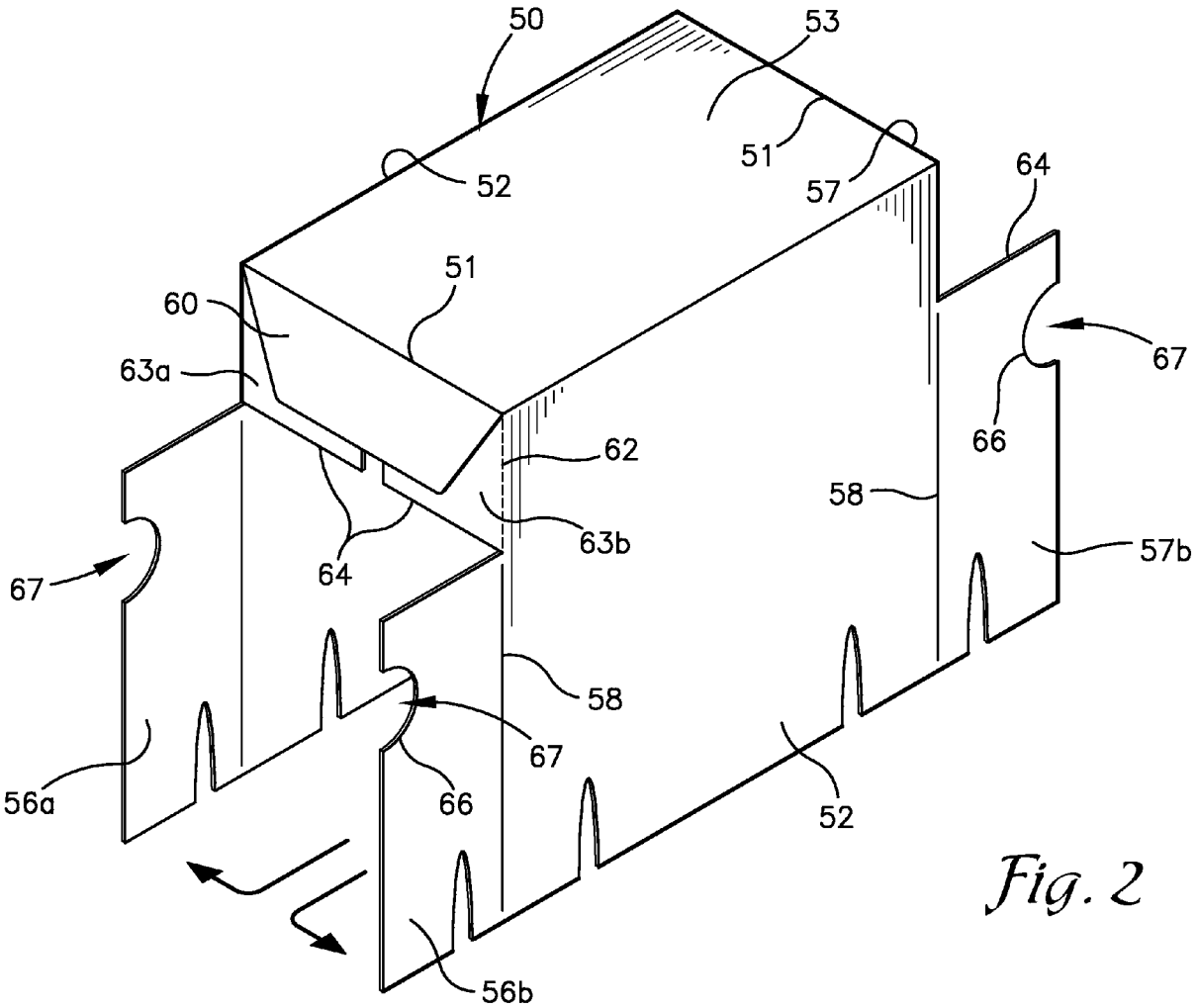
FIG. 2 of the drawings is a perspective view of the lid means with a few partially separable members in a substantially open position.
Figure 3:
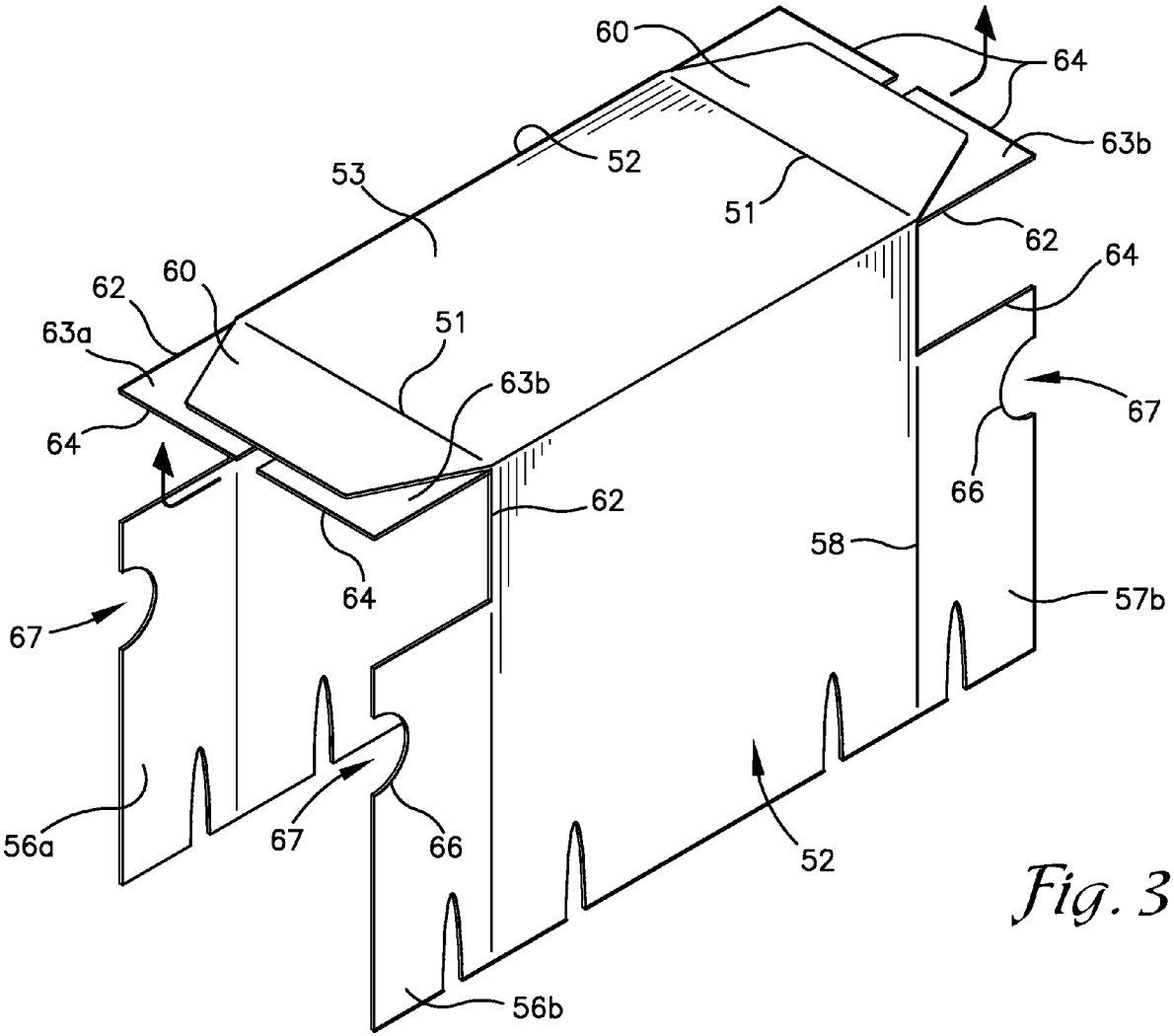
FIG. 3 of the drawings is a perspective view of the lid means with all partially separable members in a substantially open position.

As shown in detail in FIGS. 1-3, top flap member 60 has a substantially inverted trapezoidal configuration. The diagonal sides of this configuration serve to make perforated folding line 62 and perforated line 64 visible, as compared, for instance, to vertical sides of the configuration, which are likely to cover the lines underneath or close to the outskirt of flap member 60. The distance between the perforated line 64 and the folding line 51 is comparable to ½ of the width of the lid front and back wall member 56 and 57, or equivalent to the width of the lid front or back wall half member 56*a*, 56*b*, 57*a* or 57*b*.

As shown in detail in FIG. 1, frangibly integrated separable member 65 and its surrounding fully frangible perforation line 66 has a circle configuration to create a handle aperture 67. The handle aperture 67 may be of substantially round, oval or any other shape with a size such that two, three, four, six or eight fingers of an average person can fit in and pull the edge of the periphery line of handle aperture 67 and exert force enough to break the perforation line 64.

Lid means 50 further includes flap opening means for facilitating movement of half members of lid front and back wall member 56*a*, 56*b*, 57*a* and 57*b*, and frangibly integrated partially separable flip member 63*a* and 63*b* of both lid front and back wall member 56 and 57 from their substantially closed position (FIG. 1) to their substantially open position (FIGS. 2-4) while two frangibly integrated partially separable flip member 63*a* and 63*b* are attached to top flap member 60 by adhesive 90 before and after the movement. In this preferred embodiment, the flap opening means comprise prompting frangibly integrated separable member 65, which articulates from a fully frangible perforation line 66 of each of lid front and back wall member 56 and 57. By pulling upon the handle aperture 67 on the lid front wall member 56 with force sufficient to break perforation line 64, member halves 56*a* and 56*b* are enabled to move from their substantially closed position to its substantially opened position, each has association with lid means 50 though folding line 58. The flap opening means of lid means 50 further comprises pulling upon the top flap member 60 attached frangibly integrated partially separable flip member 63*a* and 63*b* on the broken perforation line 64 to further break the perforated folding line 62, such that member 63*a* and 63*b* on the lid front wall member 56 are moved from their substantially closed position (see FIGS. 1-2) to its substantially opened position (FIG. 3-4), with association with lid means 50 through folding line 51 through attachment to top flap member 60 by adhesive. Using similar means, first by pulling upon the handle aperture 67 on the lid back wall member 57 with force sufficient to break perforation line 64, member halves 57*a* and 57*b* are moved from their substantially closed position to its substantially opened position, each has association with lid means 50 though folding line 58. The flap opening means of lid means 50 further comprises pulling upon the top flap member 60 attached frangibly integrated partially separable flip member 63*a* and 63*b* on the broken perforation line 64 to further break the perforated folding line 62, such that member 63*a* and 63*b* on the lid back wall member 57 are moved from their substantially closed position (see FIGS. 1-2) to its substantially opened position (FIG. 3-4), with association with lid means 50 through folding line 51 through attachment to tope flap member 60 by adhesive.

Figure 4:
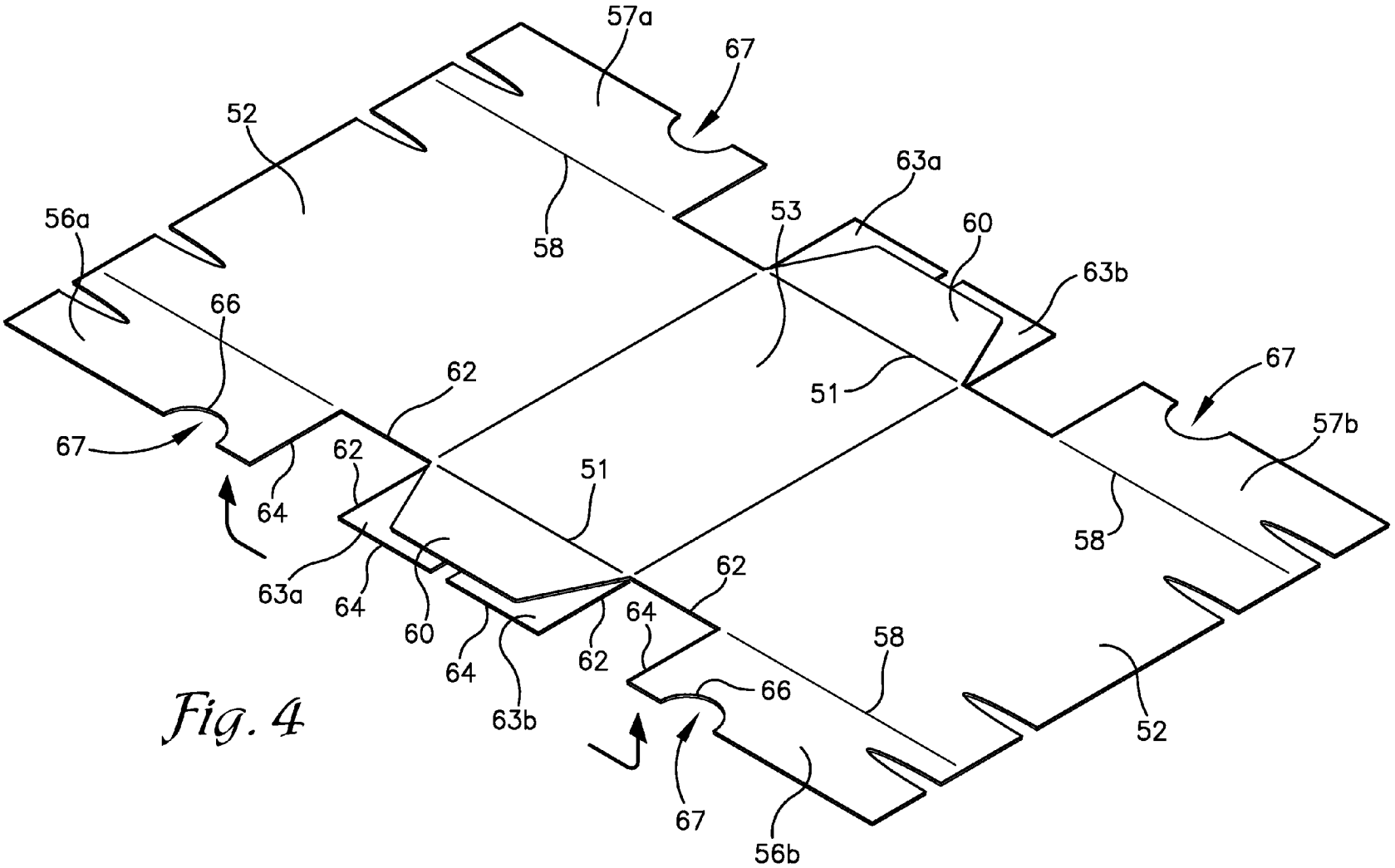
FIG. 4 of the drawings is a perspective view of a blank for forming the lid means.

Once both front and end frangibly integrated partially separable flip member 63*a* and 63*b* have in turn been moved to their substantially open position from their substantially closed position, and both lid front and back wall member half members 56*a*, 56*b*, 57*a* and 57*b* have in turn been moved to their substantially open position from their substantially closed position, as seen in FIG. 4 lid means 50, formerly in a configuration affixable to tray means 30, may be opened up, spread all half members 56*a*, 56*b*, 57*a*, and 57*b*; said top flap member 60 attached frangibly integrated partially separable flip members 63*a* and 63*b*, and unfolding opposing lid side walls 52, such that all facets of said lid means are laid flat in a single panel in one dimension (FIG. 4).

Tray means 30 and lid means 50 are both preferably constructed from a corrugated paperboard material. Similar to lid means 50 in FIG. 1, tray means 30 includes tray bottom panel member 31, two opposing tray side wall members 32, tray front wall member 36, and tray back wall member 37. Lid means 50 is positionable over or inside and thus attachable to at least a portion of tray means 30, such that the tray side wall members 32, tray front wall member 36 and tray back wall member 37 may sit either outside or inside of the lid means 50 in various embodiments. Lid means 50 is thus securely affixable to tray means 30 so as to cover goods during shipping and storage of apparatus 20. Tray means 30 carries goods, which are covered during shipping and storage by attachable lid means 50.

In some embodiments of tray means 30, a similar frangibly integrated separable member 65', which articulates from a fully frangible perforation line 66' of each of tray front and back wall member 36 and 37 may be alternatively or additionally integrally included such that a handle aperture 67' is formed through tray front and side wall member 36 and 37 and at corresponding positions of lid front and back wall member 56 and 57 such that handle aperture 67 included in the lid means 50 and handle aperture 67' included in the tray means 30 overlap, after separating frangibly integrated separable member 65' included in tray front and back wall member 36 and 37. The overlapped handle aperture 67 included in the lid means 50 and handle aperture 67' included in the tray means 30 provides a means for carrying the goods in the shipping apparatus 20 comprising both the lid means 50 and the tray means 30.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A shipping container apparatus ready for unfolding, said shipping container apparatus being convertible to a flattened single panel for storage or recycling, said shipping container apparatus comprising:

lid means releasably attached to tray means for holding and displaying goods, said lid means having two parallel lid wall members, each having two half members adjacent to a frangibly integrated partially separable flip member, and one top flap member, wherein said half members and said frangibly integrated partially separable flip members share a first perforation line parallel to lid top member, wherein said frangibly integrated partially separable flip members share a second perforation line overlapping with a folding line vertical to said lid top member between two adjacent lid wall members, and wherein said top flap member articulates from lid top wall member at a second fold line and is attached to said two frangibly integrated partially separable flip member during said movement;

flap opening means for facilitating movement of said half members, said frangibly integrated partially separable flip members, and said top flap member from a substantially closed position to a substantially open position; and said tray means having a bottom panel member and at least one tray wall member.

2. The shipping container apparatus of claim 1, wherein each of said two parallel lid wall members having two half members includes at least one frangibly integrated separable member, said frangibly integrated separable member is surrounded by a fully frangible third perforation line encircling a periphery of said at least one frangibly integrated separable member to enable complete separation of said at least one frangibly integrated separable member from said at least one lid wall member.

3. The shipping container apparatus of claim 2, wherein said frangibly integrated separable member may be separated from said lid wall member and forms at least one handle aperture through said at least one lid wall member of said lid means.

4. The shipping container apparatus of claim 2, wherein each of said two parallel lid wall members having two half members includes one frangibly integrated separable member, such that each of the two halves of said lid wall member has half of a configuration of said frangibly integrated separable member; wherein said fully frangible third perforation line encircling a periphery of said frangibly integrated separable member is configured as substantially round, oval or any other shape.

5. The shipping container apparatus of claim 4, wherein said frangibly integrated separable member may be separated from said lid wall member and forms one handle aperture through said at least one lid wall member of said lid means, wherein each of the two halves of said lid wall member has half of a configuration of said handle aperture.

6. The shipping container apparatus of claim 1, wherein said apparatus further includes flap opening means in at least said lid means for facilitating movement of said half members, said frangibly integrated partially separable flip members, and said top flap member from a substantially closed position to a substantially open position.

7. The shipping container apparatus of claim 1, wherein said flap opening means comprises:

prompting said at least one frangibly integrated separable member, such that said frangibly integrated separable member separates from said fully frangible third perforation line to create a handle aperture; wherein said handle aperture has the same configuration and with substantially same size as the frangibly integrated separable member;

pulling the periphery line of said handle aperture and exerting sufficient force to break said first perforation line, such that said two half members adjacent to said frangibly integrated partially separable flip member are movable; and pulling said frangibly integrated partially separable flip member on the side with said broken first perforation line, such that said second perforation line overlapping with said folding line vertical to said lid top member between two adjacent lid wall members is broken, wherein said frangibly integrated partially separable flip members are moveable, and wherein said frangibly integrated partially separable flip members are attached to said top flap member during the movement.

8. The shipping container apparatus of claim 7, wherein said flap opening means further comprises: spreading all said half members, said top flap member attached frangibly integrated partially separable flip members and unfolding said opposing lid side walls, such that all facets of said lid means are laid flat in a single panel in one dimension.

9. The shipping container apparatus of claim 1, wherein said at least one top flap member has a substantially inverted trapezoidal configuration.

10. The shipping container apparatus of claim 9, wherein said top flap member has a height slightly shorter than or equivalent to the height of said frangibly integrated partially separable flip member.

11. The shipping container apparatus of claim 1, wherein said lid means has two side wall members, a front wall member, and a back wall member.

12. The shipping container apparatus of claim 11, wherein said tray means has two side wall members, a front wall member, and a back wall member.

13. The shipping container apparatus according to claim 11, wherein:

said lid means includes opposing lid front wall member and lid back wall member, each of said lid front wall member and lid back wall member including a corresponding frangibly integrated separable member; and said tray means includes opposing tray front wall member and tray back wall member, each of said tray front wall member and tray back wall member including a corresponding frangibly integrated separable member, each said frangibly integrated separable member of said tray means overlaps with corresponding frangibly integrated separable member of lid means;

wherein removal of corresponding frangibly integrated separable member of said lid means and tray means forms a handle aperture enabling carrying the goods in said shipping apparatus comprising both said lid means and said tray means; wherein said lid means is positioned attachable to at least a corresponding portion of said tray means, and wherein said lid means is positionable over or inside said tray means.

14. The shipping container apparatus of claim 1, wherein said top flap member articulates from lid top wall member at a second fold line and is attached to said two frangibly integrated partially separable flip members using an adhesive capable of effecting a paperboard to paperboard bond disposed therebetween.

15. The shipping container apparatus of claim 14, wherein said adhesive comprises a cold resin adhesive.

16. The shipping container apparatus according to claim 14, wherein said adhesive comprises a hot-melt adhesive.

17. A shipping container apparatus in unfolded position for storage or recycling, and comprising:

a central panel in the shape of a quadrilateral and having two pairs of opposed ends;

a first wall panel connected to said central panel by a first hinge line, said first wall panel including a pair of opposed wall flaps having a top edge, a bottom edge, an inside edge and an outside edge, with each said wall flap being connected to said first wall panel by a pair of second hinge lines along each said inside edge, wherein said first and said second hinge lines are substantially perpendicular to one another;

a second wall panel connected to said central panel by a third hinge line, said second wall panel including a pair of opposed wall flaps, with each said wall flap being connected to said second wall panel by a pair of fourth hinge lines, wherein said first and third hinge lines are located on opposed ends of said central panel and are substantially parallel to one another and wherein said third and fourth hinge lines are substantially perpendicular to one another;

a pair of central flap members, connected to opposed sides of said central panel by a pair of fifth hinge lines, wherein each of said pair of fifth hinge lines is substantially continuous with at least one of said second and fourth hinge lines;

each of said first and second wall panels further including a first free edge beginning at said first or third hinge line and extending in a direction perpendicular to said first or third hinge line and terminating at a stopping point along at least a portion of one of said second or fourth hinge lines, the inside edge of said first or second wall flap further comprising a second free edge; and wherein at least one of said wall flaps includes a third line of weakness located between said second free edge and said bottom edge, said third line of weakness forming the shape of a handhold and extending from said outer edge toward said inside edge, turning toward said bottom edge and turning back again toward said out edge.

18. The shipping container apparatus of claim 17, wherein the shape formed by said third line of weakness is selected from the group consisting of a semi-circle, a quadrilateral, and a triangle.

19. The shipping container apparatus of claim 17, wherein said third line of weakness begins and terminates at said outer edge.

20. The shipping container apparatus of claim 17, wherein at least two of said wall flaps include a third line of weakness.

* * * * *